United States Patent [19]

Roetter et al.

[11] 4,169,341

[45] Oct. 2, 1979

[54] DOCUMENT COLLATING AND ENVELOPE STUFFING APPARATUS

[75] Inventors: Francis T. Roetter, Westport; Frank A. Oeschger, East Norwalk; Charles B. Pearson, Cos Cob, all of Conn.

[73] Assignee: Pitney-Bowes, Inc., Stamford, Conn.

[21] Appl. No.: 870,741

[22] Filed: Jan. 19, 1978

[51] Int. Cl.[2] ..... B65B 35/50

[52] U.S. Cl. ..... 53/154; 53/266 A; 53/540; 53/569

[58] Field of Search ..... 53/154, 266 A, 531, 53/540, 569; 198/421

[56] References Cited

U.S. PATENT DOCUMENTS

| | | | |
|---|---|---|---|
| 2,872,020 | 2/1959 | Hansel et al. | 198/421 |
| 3,414,257 | 12/1968 | Muller | 198/421 X |
| 3,423,900 | 1/1969 | Orsinger | 53/266 A |
| 3,530,643 | 9/1970 | Levi | 53/209 X |
| 3,965,644 | 6/1976 | Stocker | 53/266 A |

*Primary Examiner*—Horace M. Culver

*Attorney, Agent, or Firm*—Peter Vrahotes; William D. Soltow, Jr.; Albert W. Scribner

[57] ABSTRACT

This invention relates to a document collating and envelope stuffing apparatus having a continuous conveying mechanism that collects and collates documents from feeding stations and conveys the collated documents to an envelope stuffing station in a continuous manner. The feeding stations have platforms associated therewith where the documents are deposited so as to be picked up by the conveying mechanism and subsequently stuffed into envelopes. Downstream from the stuffing station is another conveying mechanism that conveys the stuffed envelopes to sealing and postage metering devices.

19 Claims, 7 Drawing Figures

DOCUMENT COLLATING AND ENVELOPE STUFFING APPARATUS

BACKGROUND OF THE INVENTION

In large volume collating and stuffing apparatus of the type having a series of document feeding stations located above a feed path, a conveyor is provided for collecting the documents from the feeding stations while collating the same and an envelope stuffer is located downstream from the feeding stations for collectively stuffing the collated documents into an envelope. There is a need in such large volume collecting and stuffing apparatus for increasing the speed of such machines. Presently commercially available collating and stuffing machines operate on an intermittent or interrupted basis, i.e., the collection of documents at the respective feeding stations requires the conveying mechanism to come to a full stop and the subsequent stuffing of the envelopes with the documents again requires the conveying mechanism to come to a full stop. This requirement for a halt in the operation at each station is occasioned by designs that require the positive handling of the documents through clamps or opposed, closable fingers. Using clamps not only requires intermittent drive but also tends to skew and even occasionally tear documents. A shortcoming of intermittent drive, in addition to loss of time, is that such drive requires the use of geneva gears which quickly wear. Examples of such document collating and envelope stuffing apparatus are shown in U.S. Pat. Nos. 3,049,845, 3,965,644 and 3,934,867. It obviously would be desirable to have a collating and stuffing apparatus that is capable of continuous operation so that the output of the machine may be increased accordingly.

SUMMARY OF THE INVENTION

The instant invention is directed to collating and stuffing apparatus wherein each feeding station along the feed path is provided with a platform which is of a size that it is able to support a document fed by the feeding station. The conveying mechanism has a plurality of pushers that are adapted to engage the documents on their ends as the documents rest on the platforms and convey the documents one upon another until they reach the stuffing station. At the stuffing station, a combination of fingers is operative to open an envelope thereby allowing the collected documents to be stuffed into the envelope. The conveying mechanism comprises two chain mechanisms, the first chain mechanism performing the collating function and the second chain mechanism performing the stuffing function. The second chain mechanism may be operative to travel at a faster speed than the first chain so that the stuffing operation takes place more rapidly thereby avoiding interference with the conveyance of collated documents. Another feature of the invention is that a third chain conveying mechanism is located downstream from the stuffing station to serve as part of a transfer mechanism able to convey the stuffed envelopes to a sealing member and a postage metering device.

DETAILED DESCRIPTION OF THE INVENTION

Figure 1:
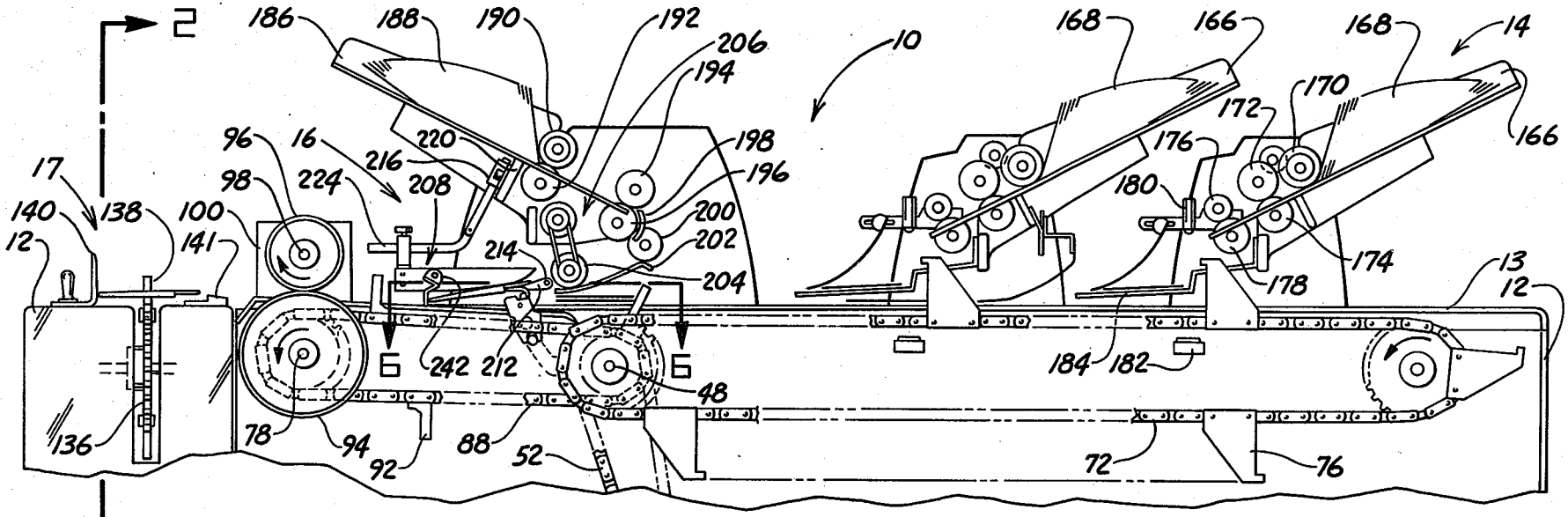
FIG. 1 shows a longitudinal cross sectional view of a document collating and envelope stuffing apparatus constructed in accordance with the instant invention.

Referring now to the drawing, a document collating and stuffing apparatus is shown generally at 10 and has a frame or housing 12 with a longitudinally extending deck 13. For purposes of orientation, the right of the apparatus as seen in FIG. 1 will be referred to as the upstream end and the left as the downstream for reasons that will become evident. Disposed along the length of the apparatus 10 in series are a plurality of feeding stations 14. Downstream from the feeding stations is an envelope stuffing station 16 and a transfer station 17. A motor 18 is supported within the frame 12 and has a pulley 20 drivingly supported by its output shaft 22. A stanchion 24 is supported by the frame 14 and has a shaft 26 rotatably received therein. A pair of pulleys 28 and 30 are secured to the shaft 26. A belt 32 is trained about pulleys 20 and 28 to provide drive from the motor 18 to the shaft 26. A shaft 34 is rotatably supported within the frame 12 and has a pulley 36 secured to one end thereof. A belt 38 is trained about the pulleys 30, 36 to provide drive from the shaft 26 to the shaft 34. Also secured to the shaft 34 is a clutch 40 from which an output shaft 42 extends. The output shaft 42 supports a sprocket 44 and has at the opposite end a brake member 46. The clutch 40 and brake member 46 provide means for driving and braking the shaft 42 as required.

Figure 3:
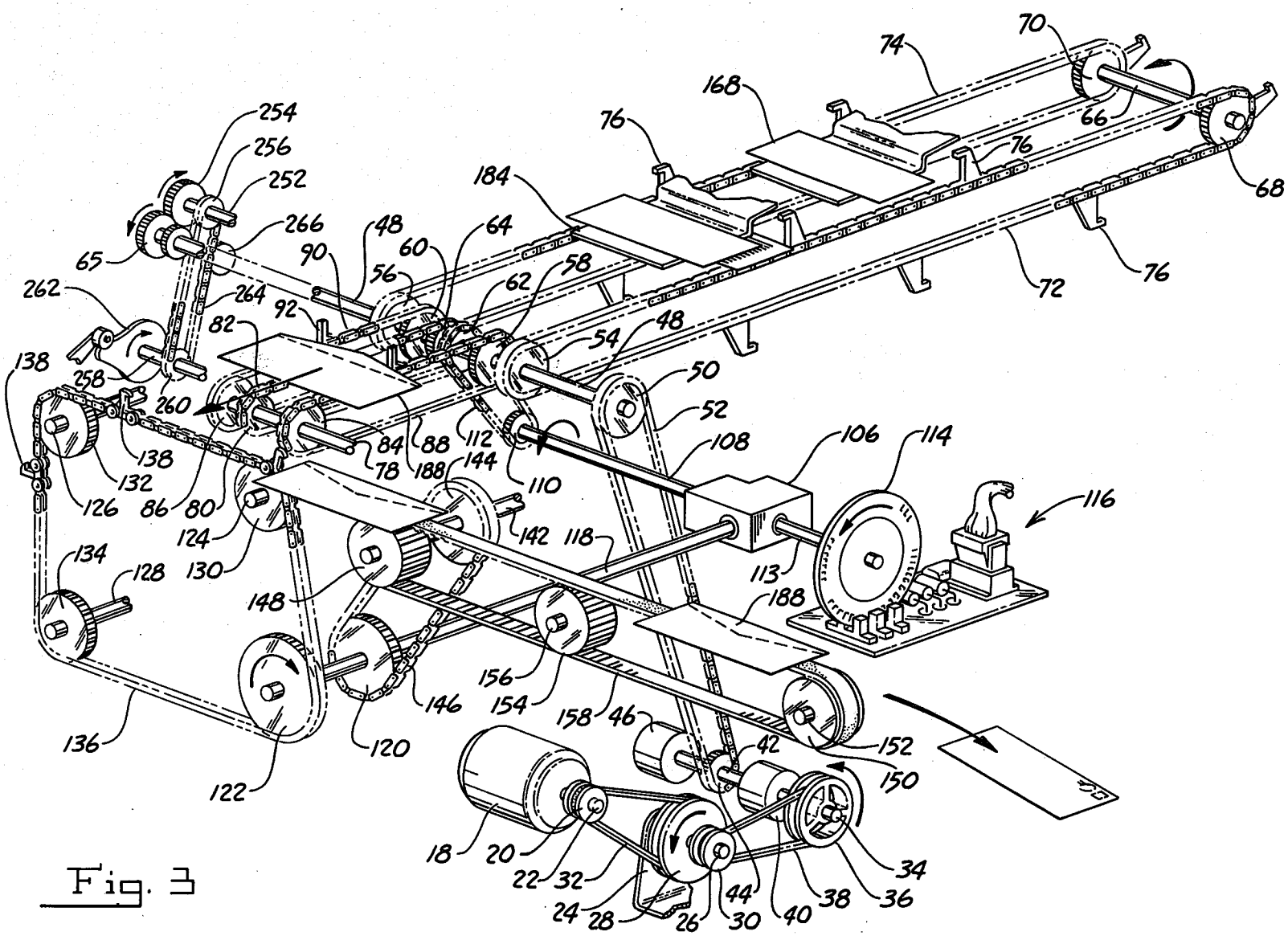
FIG. 3 shows a perspective view of the drive mechanism incorporated in the apparatus shown in FIGS. 1 and 2.
Figure 5:
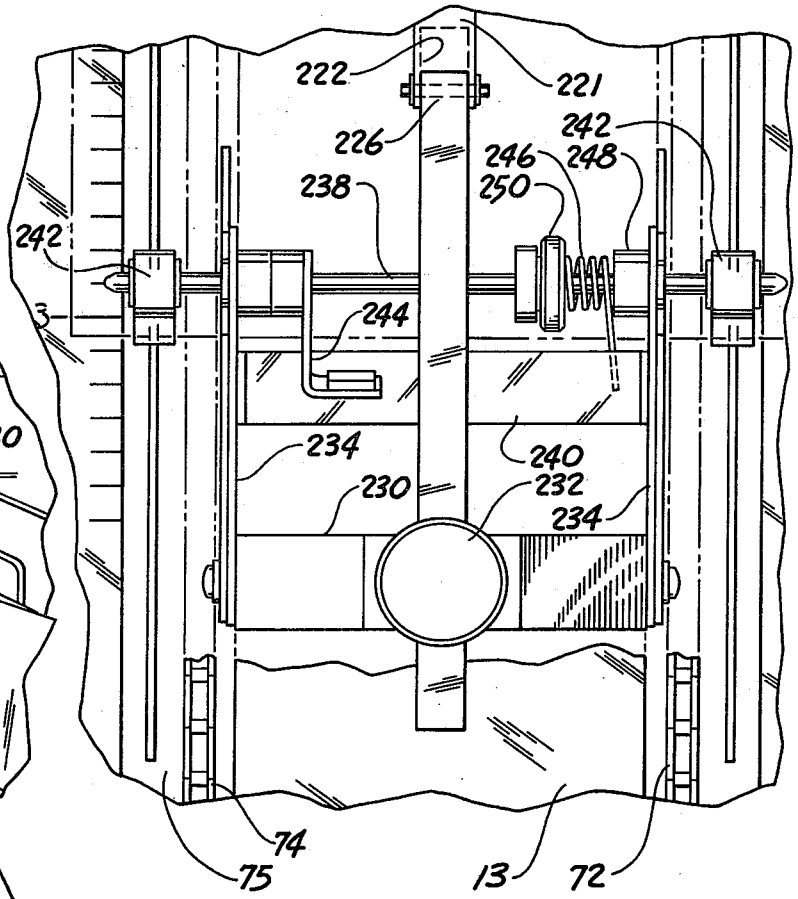
FIG. 5 is a plan view of a portion of the stuffing station shown in FIG. 4 taken along the lines 5—5.

At a location above the shaft 42 is another shaft 48 parallel thereto that is rotatably supported within the frame 12. The shaft 48 has a sprocket 50 secured at one end thereof, there being a chain 52 trained about the sprockets 44, 50 in order to provide drive from the output shaft 42 to the shaft 48. Also secured to the shaft 48 is a first pair of spaced apart sprockets 54 and 56 and supported by the shaft is a pair of idler sprockets 58 and 60. Another pair of sprockets 62 and 64 are secured to the shaft 48 for rotation therewith and are disposed between the idler sprockets 58, 60. A gear 65 is secured to one end of the shaft 48 for rotation therewith. Spaced relative to the shaft 48 and parallel and upstream thereto is another shaft 66 having a pair of sprockets 68 and 70 secured to the ends thereof. A pair of chains 72 and 74 are trained about the sprockets 54, 68, and 56, 70, respectively to rotate the shaft 66 in the direction indicated by an arrow in FIG. 3 and are received within longitudinal openings 75 in the deck 13. Each of the chains 72, 74 has a plurality of pushers 76 extending outwardly therefrom, the pushers assuming a position generally normal to the direction of travel of the chains 72, 74 when located within the openings 75 of the deck 13.

Figure 2:
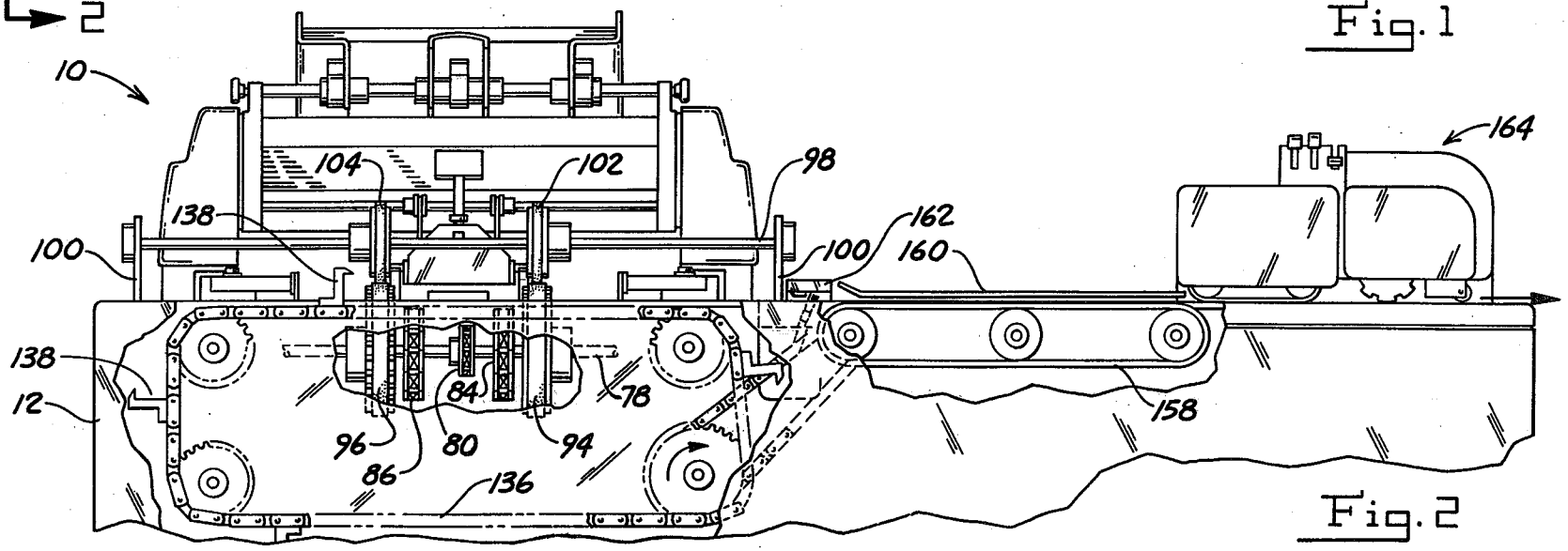
FIG. 2 shows a cross sectional view of the apparatus of FIG. 1 taken along the lines 2—2.

Downstream and parallel to the shaft 48 is another shaft 78 that is rotationally supported by the frame 12. Supported by the shaft 78 for rotation therewith is a sprocket 80, there being a chain 82 trained about the sprockets 64, 80 to provide drive from the shaft 78. Another pair of sprockets 84 and 86 are secured to the shaft 78, these sprockets being located on opposite sides of the sprocket 80. A chain 88 is trained about the idler sprocket 58 and the sprocket 84 and another chain 90 is trained about idler sprocket 60 and sprocket 86. Pushers 92 are attached to each of the chains 88, 90, the pushers on each chain being laterally aligned to a corresponding pusher on the opposite chain. Also secured the shaft 78 are a pair of opposed rollers 94 and 96 (see FIG. 2), the sprockets 84, 86 being located intermediate these two rollers. Located immediately above the shaft 78 is another shaft 98 that is supported by a pair of stanchions 100, the shaft 98 extending parallel to the shaft 78. The shaft 98 supports a pair of idler rollers 102 and 104 that are in operational engagement with rollers 94 and 96, respectively.

Supported within the frame 12 is a gear box 106 that has a shaft 108 extending from one side thereof, the shaft 108 having a sprocket 110 located at its outer end. A chain 112 is trained about the sprockets 62 and 110 to provide drive to the shaft 108. Another shaft 113 extends from the opposite side of the gear box 106 and has a timing disc 114 secured to its end. The timing disc 114 has a portion thereof received within a control circuit 116, the control circuit being provided to correlate the timing of the various components of the apparatus 10.

Another shaft 118 extends from the gear box 106 in a direction perpendicular to the shafts 108, 113. A pair of sprockets 120 and 122 are secured to the distal end of the shaft 118. A plurality of shafts 124, 126 and 128 are supported by the frame 12 have idler sprockets 130, 132 and 134 secured thereto, respectively, to form a generally rectangular configuration in conjunction with shaft 118 and sprocket 122 and are part of the transfer station 17. A chain 136 is trained about the sprockets 122, 130, 132 and 134 and has a plurality of pushers 138 attached thereto. Preferably, the distance between adjacent pushers 138 on chain 136 is the same as the distance between the longitudinally spaced pushers 76 on chain 72 and the longitudinally spaced pushers 76 on chain 74 as well as the longitudinal distance between the pushers 92 on the chains 88 and 90. Having such equivalent distance among the groups of pushers 76, 92 and 138 is helpful for timing purposes as well as uniformity of manufacture. A stop 140 and an opposite guide plate 141 are secured to the frame 12 and are located downstream from the chain 88 and above the chain 136.

Extending parallel to the shaft 118 is another shaft 142 that has secured thereto a sprocket 144. A chain 146 is trained about the sprockets 120, 144 to provide drive to the shaft 142 from the shaft 118. Secured to the end of the shaft 142 is a pulley 148. Spaced relative to the pulley 148 is another pulley 150 that is rotatably supported upon a shaft 152, there being still another pulley 154 intermediate the two pulleys 148, 150 that is rotatably supported by another shaft 156. A belt 158 is trained about the pulleys 148, 150 and 154. Located above the belt 158 is an envelope flap turning device 160, a moistening device 162 and a postage meter 164 (see FIG. 2).

Supported upon the frame 12 above the chain 72 are a plurality of feeding stations 14 each of which has a hopper 166 capable of holding documents 168 therein. A drive roller 170 engages the first document 166 in the hopper 14 and drives it to the nip of a pair of rollers 172, 174. Another pair of rollers 176, 178 are located adjacent the first rollers 172, 174 and immediately adjacent the former rollers 176, 178 is a light 180. Located below the upper portion of the chain 72, 74 and in alignment with the light 180 is a photocell 182, the light 180 and photocell 182 combination being provided to detect the presence of a document 168 therebetween. Each feeding station 14 is provided with a platform 184, the platform being capable of supporting documents 168 that are fed from the hopper 166. The structure of the platform 184 is such that it is located between the laterally opposed pushers 76 on the chains 72, 74. The feeding station 14 may be of any type capable of feeding documents 168 to the platform 184. Although one type of such feeding station 14 is shown and described it will be appreciated that other types known in the art may be used equally well.

Referring now to the stuffing station 16 which is located downstream from the feeding stations 14, the same is provided with a hopper 186 capable of holding a stack of envelopes 188, A pair of opposed rollers 190 and 192 are provided to remove the envelopes 188 one at a time and direct them to another pair of rollers 194 and 196. Adjacent the nip of the rollers 194, 196 is a deflecting vane 198 and another roller 200 is adjacent the roller 196. Below the two rollers 198, 200 is a chute 202. A roller 204 is located at one end of the chute 202 and is driven by a pulley-belt assembly generally shown at 206. Located downstream from the chute 202 is a detaining member generally shown at 208. Once more, it will be appreciated that any type of envelope conveying mechanism may be used to deliver envelopes 188 to the detaining member 208.

Figure 4:
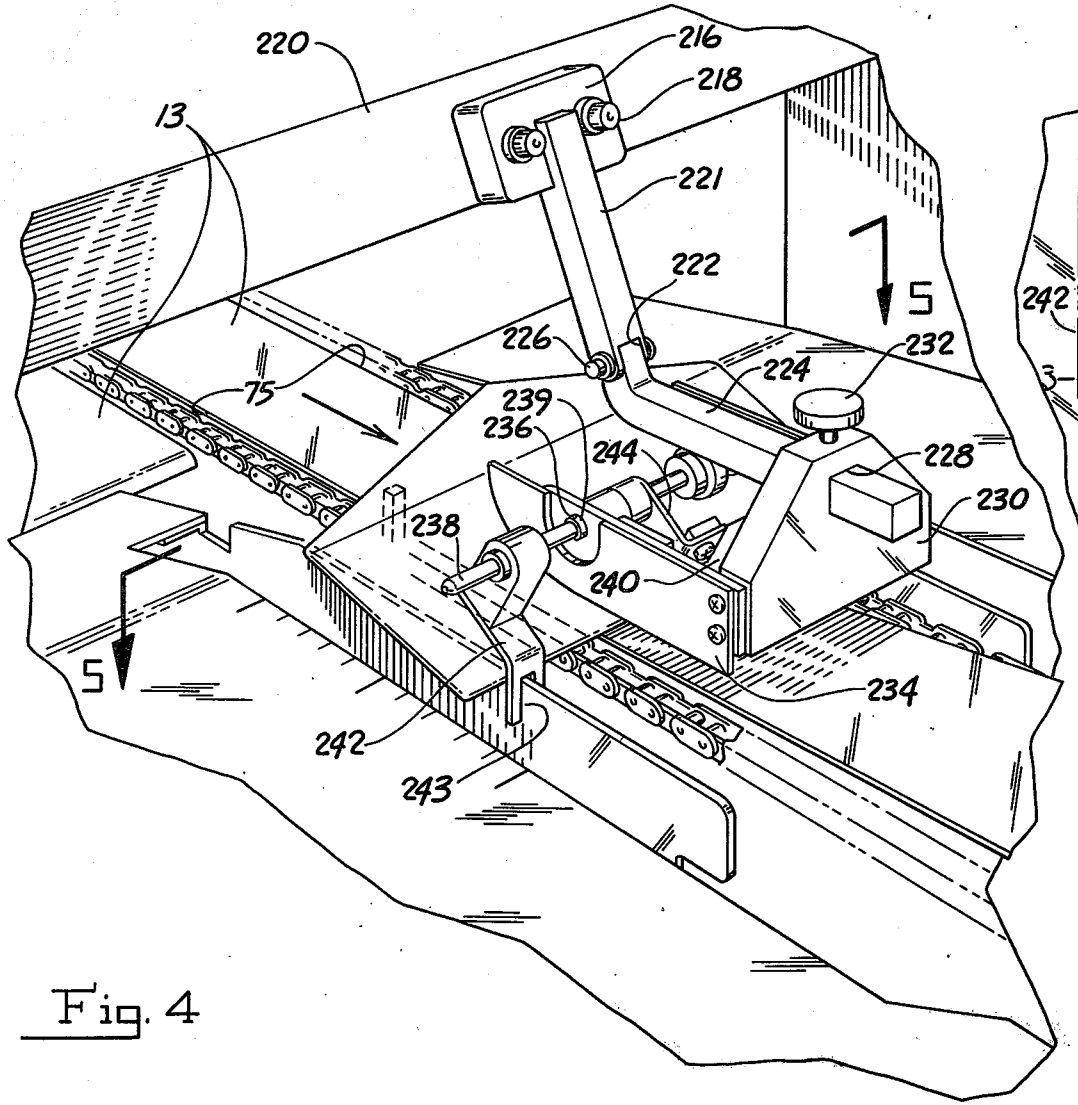
FIG. 4 is an enlarged perspective view of the stuffing station of the apparatus in FIG. 1.

A pair of opposed fingers 212 form part of the detaining member 208 and are mounted upon a shaft 214 supported by the frame 12. A plate 216 is secured as by bolts 218 to a bracket 220 secured to the hopper 186. Integral with the plate 216 is a depending bar 221 that has a channel 222 at the lower end thereof. An arm 224 is received within the channel 222 and a nut-bolt assembly 226 is received within the channel 222 of the bar 221 to allow horizontal adjustment of the arm 224. The arm 224 extends through the opening 228 of a support plate 230, there being an adjusting screw 232 received within the top of the support plate to allow adjustment of the support plate along the arm 224 through the loosening and tightening of the adjusting screw. A pair of side plates 234 are secured to the ends of the support plate 230, there being an opening 236 within each of the side plates. A shaft 238 is rotatably received within the openings 236 and is supported by bushing 239 secured within the openings. A brace 240 is secured to and extends between the side plates 234. An arm member 242 is secured to each end of the shaft 238 and the arm members have channels 243 at the ends thereof. A generally L-shaped clip 244 is secured to the shaft 238 intermediate the plates 234. A spring 246 is disposed about the shaft 238 and has one end thereof that engages the brace 240, the other end of the spring being secured to the shaft. The spring tends to bias the shaft 238 in a counterclockwise rotation as seen in FIG. 1 and a clockwise rotation as seen in FIG. 4 to urge the clip 244 against the brace 240 to place the arm members 242 in the position shown in FIG. 4. The spring 246 is held in place by a washer 248 and an adjusting nut 250 that are disposed about the shaft 238.

Figure 7:
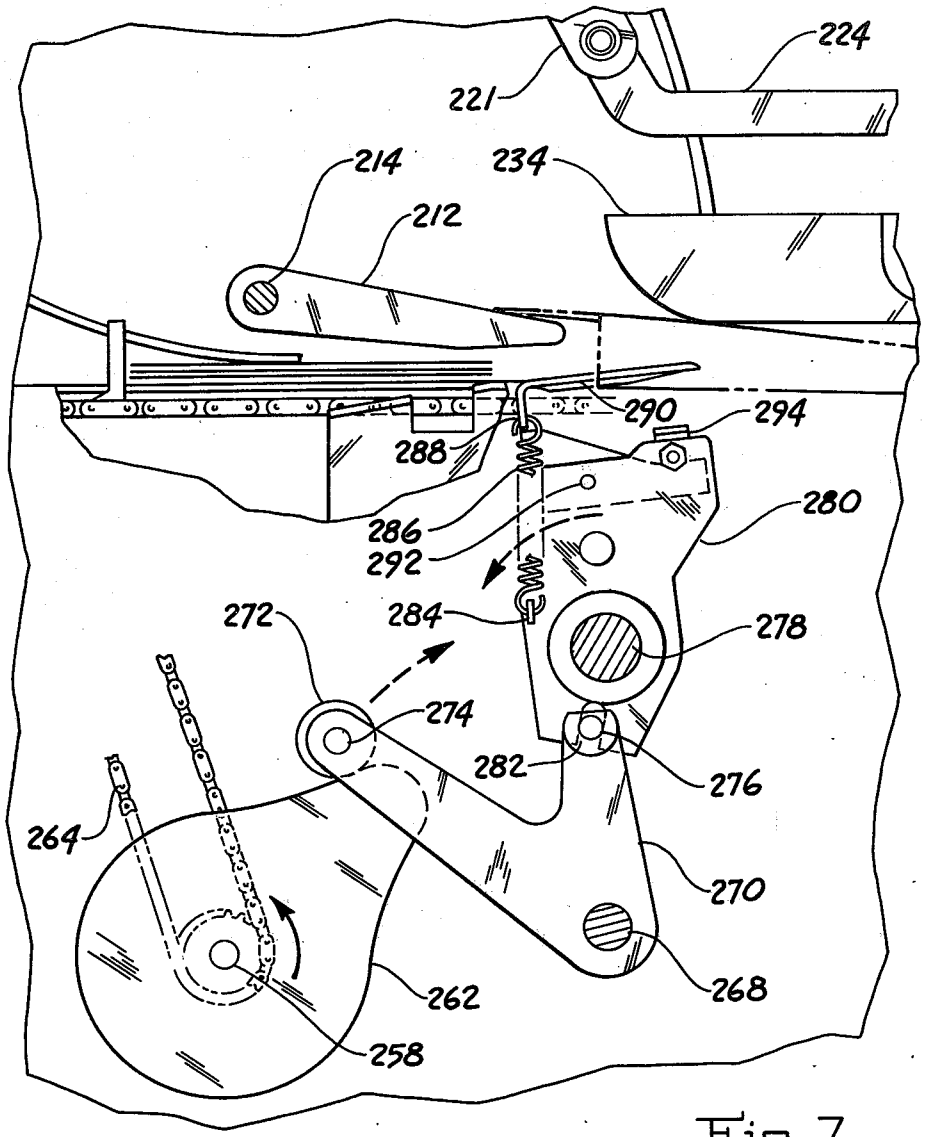
FIG. 7 is an enlarged cross sectional view of a portion of the apparatus shown in FIG. 1.
Figure 6:
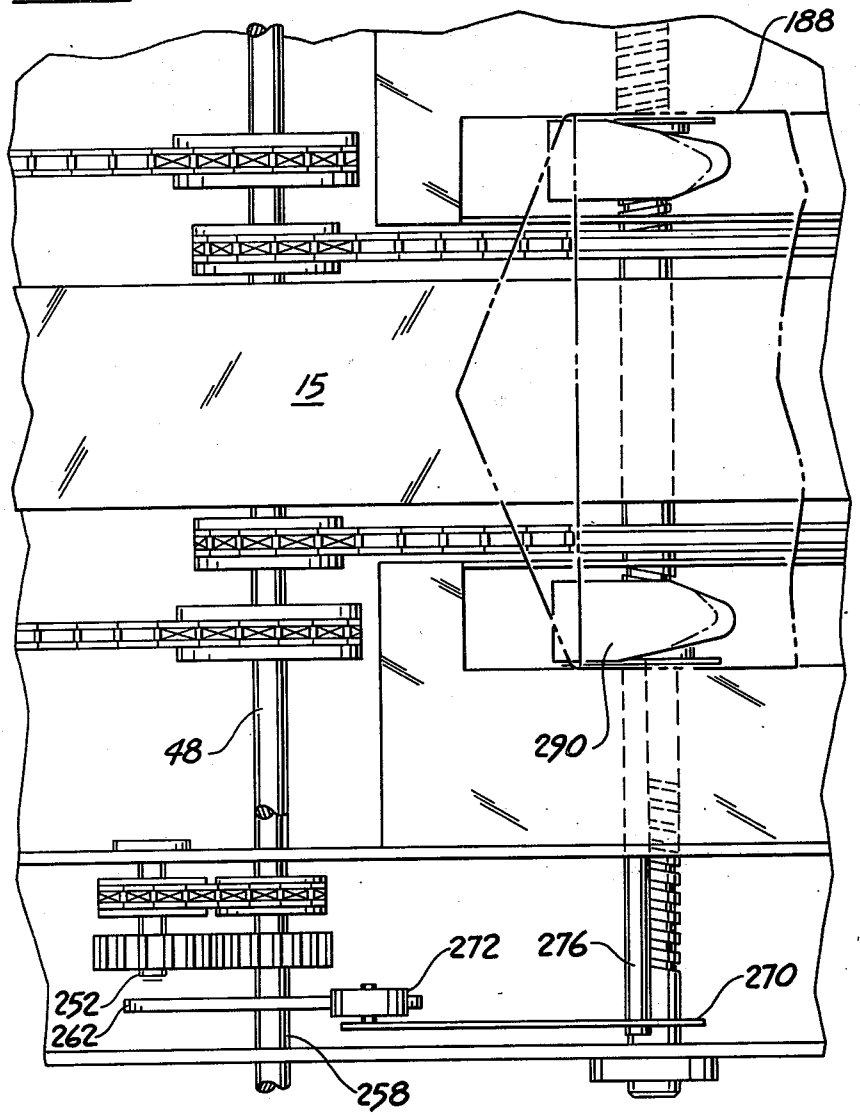
FIG. 6 is a plan view taken along the lines 6—6 of FIG. 1 with parts removed for clarity.

A shaft 252 is supported within the frame 12 and is parallel to the shaft 48. Fixedly supported upon the shaft 252 is a gear 254, that is engaged by the gear 65, and a sprocket 256. Engagement of the gears 65 and 254 provides drive from the shaft 48 to the shaft 252. Another shaft 258 is supported by the frame 12 and is parallel to the shaft 252. Supported upon the shaft 258 for rotation therewith is a sprocket 260 and a cam 262. A chain 264 is trained about the sprockets 256, 260 to provide drive from the shaft 252 to the shaft 258. A tension member 266 is supported by the frame 14 (by means not shown) and engages the chain 264 to maintain tension therein. A shaft 268 (See FIG. 7) is rotatably supported within the frame 12 and has secured thereto a pair of spaced apart generally V-shaped pivot members 270 (only one being shown). One of the pivot members 270 (the one shown) has at the end thereof a cam follower 272 that is rotatably supported by a pin 274, the cam follower being in engagement with the cam 262. A rod 276 is supported by and between the pivot members 270. Another shaft 278 is supported by the frame 12 and has disposed thereabout a pair of pivot members 280 each of which has a channel opening 282 at the lower end thereof that receives the rod 276. Each of the pivot members 280 has a clip 284 that receives one end of a compression spring 286. The other end of the compression spring 286 is received within an opening 288 of a finger member 290, each finger member being privotally supported upon the pivot member 280 by a pin 292 and having a portion that extends into the opening 75 of the deck 13. A stop 294 is provided upon each of the pivot members 280 to limit rotation of the finger member 290 about the pin 292 by abutment with the deck 15.

In operation, the motor 18 provides drive to the shaft 34 and the clutch 40 and brake 46 control drive to the shaft 42. The chain 52 transmits drive from the shaft 42 to the shaft 48 which, in turn, provides drive to the sprockets 54, 56 thereby providing drive to the chains 72, 74. With the occurrence of drive to the chain 72, the pushers 76 are driven generally longitudinally across deck 13, counterclockwise as seen in FIG. 1, a pusher 76 of chain 72 being in lateral alignment with a pusher of chain 74. Drive is also provided to the shaft 78 through the chain 82 thereby providing drive to the chains 88, 90 to drive the pushers 92 in a generally longitudinal direction, counterclockwise as seen in FIG. 1. It will be observed that the pushers 76 when driven are conveyed past the platforms 184 and are able to engage and remove any documents 168 disposed upon the platforms. The lateral dimensions of the platforms 184 are such that the laterally opposed pushers 76 are just able to clear the platforms thereby being able to engage any document 168 that is disposed upon the platforms so long as the ends of each document clear the ends of the respective platform 184. It is preferred that the platforms 184 support the documents 168 in a generally horizontal position so that the documents are at rest and can readily be removed by the pushers to be placed on the deck and conveyed toward the stuffing station 16. As the pushers 76 pick up a document 168 at the platform 184 located upstream, it thereafter deposits a document from a subsequent or downstream platform upon the document from an upstream platform as it pushes the latter toward the stuffing station 16, thereby collating the documents. When the document 168 from the last downstream platform 184 has been picked up by the pushers 76 and deposited upon the prior documents, the same are delivered stacked one on top of the other to the junction of the chains 72, 74 and 88, 90. It will be noted that there is a degree of longitudinal overlapping of these two chains and they may be synchronized in such a fashion that the pushers 76 of chain 72, 74 depart at approximately the same time as the pushers 92 of chains 88, 90 arrive at the junction therebetween. In this way there is a continuous flow of the documents 168.

Preferably the chains 88, 90 are driven at a faster speed than the chains 72, 74 to avoid interference of the collated documents 168 being conveyed.

Shortly before a stack of documents 168 conveyed by the pushers 76 arrives at the upstream location of the chains 88, 90, an envelope 188 is delivered to the stuffing station 16. This is accomplished by the lowermost envelope 188 stacked in the hopper 186 being picked up by the rollers 190, 192, delivered to the rollers 194, 196 and deflecting vane 198 to be conveyed across the chute 202 to the detaining member 208. As an envelope 188 arrives at the detaining member 208 it is engaged by the finger members 242 to be detained thereby and the flap of the envelope is engaged by the fingers 212. Simultaneously, the pivot member 280 is rotated about the shaft 278 by the action of the cam 262 to insert the finger 290 into the envelope being detained by the arm members 242. The action of the fingers 290 in combination with the detention by the arms 242 opens the throat of the envelope 188 being detained. As this is done, the pusher 92 push the stack of documents 168 previously collected from the platform 184 into an envelope and continue pushing the envelope with the enclosed documents against the arm members 242 to overcome the spring 246 and drive the envelope to the nip of the rollers 94, 98. The stuffed envelope 188 is then driven against the stop 140 to settle intermediate the stop and the guide plate 141 where it is engaged by a pusher 138. The drive for the pusher 138 is provided by the chain 136 which in turn has its drive provided by the shaft 118. The pushers 138 then pick up the stuffed envelopes 188 and deliver them to the belt 158 where they are conveyed past the moistening device 162 and through the flap turning device 160 to seal the envelopes. From this point, the envelopes 188 are conveyed onto the postage meter 164 where a postage mark is imprinted thereupon. The timing of the chain 136 may be set so that as soon as an envelope 188 settles between the stop 140 and guide plate 141 it is met by a pusher 138.

It will be appreciated that the structure described allows the operation of the apparatus 10 to be continuous, i.e., the chains 92, 94 and chains 88, 90 are in continuous operation as is the chain 136 thereby continuously keeping the documents 168 and envelopes 188 in motion once they are picked up from their respective stations. This is also true at the transfer station 17 where an envelope may be engaged by a pusher 138 as soon as it engages the stop 140. Because of this continuous operation the work output is increased significantly.

It will observed that the operation of the stuffing station is based primarily on mechanical operation and is responsive to the position of the pushers 92. The control circuit 116 with its attended timing disc 114 is provided so as to cooperate with the light 180 and photocell 182 of the feeding stations 14 and with the envelope feeding to supply the documents 160 and envelopes 188 as required. Such control circuitry 116 is well known in the art and will not be described in detail as the particular means of supply documents and envelopes to the platforms 184 and detaining member 208 respectively in a time coordinated manner does not form part of the instant invention.

What is claimed is:

1. A document collating and envelope stuffing apparatus wherein documents are collated in seriatim along a longitudinally extending feed path having an upstream end and a downstream end and then collectively stuffed into an envelope, comprising:

a plurality of platforms arranged in series along the feed path;

means for feeding documents to said platforms;

a stuffing station located on the feed path downstream from said platform, said stuffing station having means for releasably detaining an envelope at a location on the feed path and means for opening the throat of an envelope that is being detained by said detaining means;

means for feeding envelopes to said detaining means; a continuous conveying means extending along the feed path, said conveying means having two sets of longitudinally spaced pushers, said sets being spaced laterally to each other said platforms and said stuffing station being located intermediate said two sets of pushers, and said throat opening means and said detaining means being in the path of at least one of said sets of pushers; whereby, said pushers are conveyed along said feed path from the upstream end to the downstream end of the feed path, past said platforms and said stuffing station by said conveying means to collect documents placed upon said platforms, to insert collected documents into an envelope located at said detaining means, and to release said detaining means.

2. The apparatus of claim 1 wherein each of the pushers of one of said sets is laterally aligned with a pusher of the other of said sets.

3. The apparatus of claim 1 including a laterally extending conveyor located downstream from said stuffing station, said laterally extending conveyor having at least one pusher thereon.

4. The apparatus of claim 2 wherein said continuous conveying means is a pair of continuous chains each having one of said sets of pushers thereon.

5. The apparatus of claim 4 including a laterally extending continuous chain conveyor located downstream from said stuffing station.

6. The apparatus of claim 4 wherein said releasable detaining means comprises at least one finger member pivotably supported by said stuffing station and biasing means supported by said stuffing station and in engagement with said finger to urge said finger in a generally vertical position adjacent the path of a pusher of one of said first pair of chain conveyors.

7. A document collating and envelope stuffing apparatus comprising:

a plurality of platforms arranged in series along a longitudinally extending feed path;

means for feeding documents to said platforms;

a pair of laterally opposed endless chain conveyors disposed below and on opposite sides of said platforms, each chain conveyor having at least one pusher secured thereto that extends normally therefrom and is laterally aligned with a pusher on the opposed chain conveyor;

means for continuously driving said endless chain conveyors, said pushers being located along said feed path so as to be conveyed immediately adjacent the lateral ends of said platforms when said chain conveyor is being driven from an upstream end to a downstream end whereby sheets disposed on said platforms are collected by said pushers and collated along said feed path as said endless chains are being driven;

a stuffing station having means for releasably detaining envelopes and envelope throat opening means located downstream from said platforms;

means for supplying envelopes to said detaining means of said stuffing station, a second pair of laterally opposed longitudinally extending endless chain conveyors located along said feed path downstream from said first pair of endless chain conveyor and below said stuffing station, said second pair of endless chain conveyors each having at least one pusher attached thereto, a pusher on one said second chain conveyors being laterally aligned with a pusher on said opposed second chain conveyor; and means for continuously driving said second endless chain.

8. The apparatus of claim 7 including a laterally extending continuous chain conveyor located downstream from and adjacent said second pair of longitudinally extending endless chain conveyors, said laterally extending chain conveyor having at least one pusher thereon; and means for driving said laterally extending continuous chain conveyor.

9. A document collating and envelope stuffing apparatus wherein documents are collated in seriatim along a longitudinally extending feed path having an upstream end and a downstream end and then collectively stuffed into an envelope, comprising:

a plurality of platforms arranged in series along the feed path;

means for feeding documents to said platforms; a stuffing station located on the feed path downstream from said platforms, said stuffing station having means for releasably detaining an envelope at a location on the feed path and means for opening the throat of an envelope that is being detained by said detaining means;

means for feeding envelopes to said stuffing station;

a continuous conveying means extending along the feed path, said conveying means having two sets of longitudinally spaced pushers, a pusher of one of said sets being laterally aligned with a pusher of the other set, said platforms and said stuffing station being located intermediate said two sets of pushers;

means coupled to said conveying means for activating said throat opening means; whereby, said pushers are conveyed from the upstream end to the downstream end past said platforms and said stuffing station by said conveying means to push documents on said platform onto said feed path, to insert documents into an envelope located at said detaining means, and to release said retaining means.

10. The apparatus of claim 9 including a laterally extending chain conveyor located downstream from said stuffing station, said laterally extending chain conveyor having at least one pusher thereon; and means for driving said laterally extending chain conveyor.

means for conveying envelopes from said stuffing station to said laterally extending chain conveyor.

11. The apparatus of claim 10 where each set of said continuous conveying means has a plurality of longitudinally spaced pushers and said laterally extending chain conveyor has a plurality of pushers, the distance between the pushers on said laterally extending chain conveyor being equal to the distance between said longitudinally spaced pushers on said continuous conveying means.

12. A document collating and envelope stuffing apparatus wherein documents are collated in seriatim along a longitudinally extending feed path having an upstream end and a downstream end and then collectively stuffed into an envelope, comprising:

a plurality of platforms arranged in series along the feed path;

means for feeding documents to said platforms;

a stuffing station located on the feed path downstream from said platforms, said stuffing station having means for releasably detaining an envelope at a location on the feed path and means for opening the throat of an envelope that is being retained by said detaining means;

means for feeding documents to said stuffing station;

a continuous conveying means extending along the feed path, said conveying means having two sets of longitudinally spaced pushers, a pusher of one of said sets being laterally aligned with a pusher of the other set, said platforms and said stuffing station being located intermediate said two sets of pushers;

means for driving said continuous conveying means; whereby, said pushers are conveyed from the upstream end to the downstream end of the feed path past said platforms and said stuffing station by said conveying means to collect documents on said platforms and collate the same to insert the collated documents into an envelope located at said detaining means, and to release said detaining means.

13. The apparatus of claim 12 including a laterally extending chain conveyor located downstream from said stuffing station, said laterally extending chain conveyor having at least one pusher thereon; and means for driving said laterally extending chain conveyor.

14. The apparatus of claim 13 wherein each set of said continuous conveying means has a plurality of longitudinally spaced apart pushers and said laterally extending chain conveyor has a plurality of spaced apart pushers, the distance between the pushers of said laterally extending chain conveyor being equal to the distance between said longitudinally spaced pushers on said continuous conveying means.

15. A document collating and envelope stuffing apparatus wherein documents are collated in seriatim along a longitudinally extending feed path and then collectively stuffed into an envelope, comprising:

a plurality of platforms arranged in series along the feed path, each of said platforms having a lateral dimension less than the length of the documents to be conveyed;

means for feeding documents individually to each of said platforms;

a stuffing station located on the feed path at one end of the series of said platforms, said stuffing station having means for releaseably detaining an envelope at a location on the feed path and means for opening the throat of an envelope that is being detained by said detaining means;

means for feeding envelopes to said detaining means;

conveying means extending along the feed path, to define an upstream end and a downstream end;

said conveying means having two sets of laterally spaced pushers, the pushers of each set being longitudinally spaced from one another, a pusher of one of said sets being laterally aligned with a pusher of the other set; said platforms and said stuffing station being located intermediate said two sets of pushers, and said throat opening means and said detaining means being in the path of at least one of said sets of pushers;

means for driving said conveying means; whereby, said pushers are conveyed along said feed path past said platforms and said stuffing station to deliver documents to the feed path, to collate the documents that are delivered to the feed path to insert collated documents into an envelope detained by said detaining means, and to release said detaining means.

16. The apparatus of claim 15 including a laterally extending chain conveyor located downstream from said stuffing station, said laterally extending chain conveyor having at least one pusher thereon; and means for driving said laterally extending chain conveyor.

17. The apparatus of claim 16 wherein said releasable detaining means comprises at least one finger member pivotably supported by said stuffing station and biasing means supported by said stuffing station and in engagement with said finger to urge said finger in a generally vertical position adjacent the path of a pusher of one of said sets.

18. The apparatus of claim 16 wherein said longitudinally extending conveying means comprises two pairs of endless chains, each endless chain having at least one pusher attached thereto, the first of said pair of endless chains originating upstream from the most upstream of said platforms and terminating at said stuffing station and the second pair of said endless chains originating at said stuffing station and terminating at said laterally extending conveying means.

19. The apparatus of claim 18 including means of driving said first of said pair of endless chains at a first speed and means for driving said second of said pair of endless chains at a second speed, said second speed being faster than said first speed.

* * * * *